United States Patent [19]

Collier

[11] Patent Number: 4,875,249

[45] Date of Patent: Oct. 24, 1989

[54] CARPET REPAIR STEAM SYSTEM

[76] Inventor: David S. Collier, 3985 Garnetwood Chase, Mississauga, Ontario, Canada, L4W 2H3

[21] Appl. No.: 192,703

[22] Filed: May 11, 1988

[51] Int. Cl.[4] ..... B08B 3/00

[52] U.S. Cl. ..... 15/398; 15/322; 34/148; 68/222

[58] Field of Search ..... 15/320, 321, 322, 398; 8/158; 68/222

[56] References Cited

U.S. PATENT DOCUMENTS

| | | | |
|---|---|---|---|
| RE. 26,950 | 9/1970 | Hays | 15/321 |
| 1,016,435 | 2/1912 | Overholt | 15/321 X |
| 1,093,532 | 4/1914 | Cavalier | 15/322 X |
| 1,669,077 | 5/1928 | Brewer | 15/322 X |
| 2,497,435 | 2/1950 | Branneman | 15/321 X |
| 3,559,427 | 2/1971 | Baker | 68/222 |
| 4,327,459 | 5/1982 | Gilbert | 15/321 |
| 4,446,593 | 5/1984 | Bell et al. | 15/322 |
| 4,696,074 | 9/1987 | Cavalli | 15/321 |

FOREIGN PATENT DOCUMENTS

| | | | |
|---|---|---|---|
| 892658 | 3/1962 | United Kingdom | 15/322 |

*Primary Examiner*—Chris K. Moore

[57] ABSTRACT

The present invention provides a steam system for repairing bent carpet fibres and includes a steam generator and an application tool having a head with a downwardly opening oven-like steam chamber fed by the steam generator to apply steam to the bent carpet fibres at a pressure and temperature to cause fibre relaxation. The head of the application tool further includes a fibre lifter for lifting the fibres to an upstanding position after they have been relaxed by the steam.

12 Claims, 5 Drawing Sheets

FIG.1.
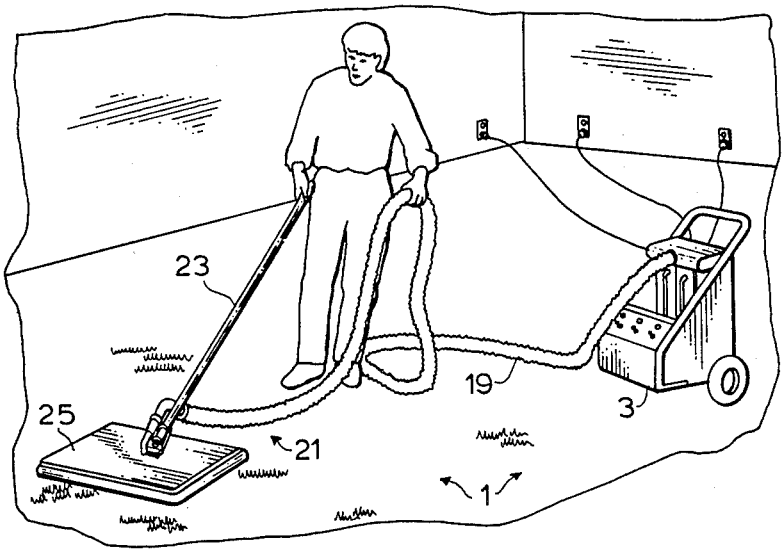
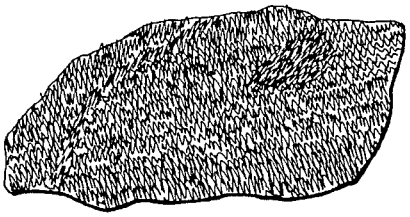
FIG.2.
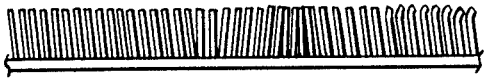
FIG.3.
FIG.4.
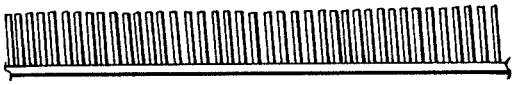

FIG.6.
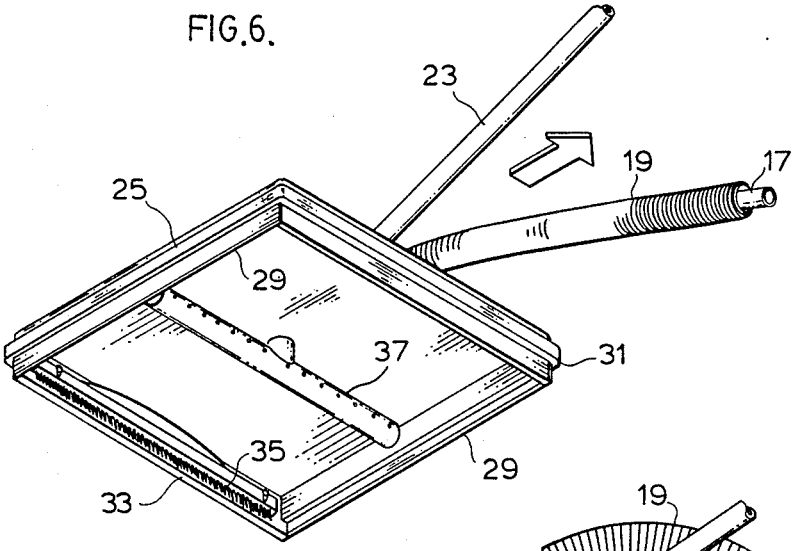
FIG.7.
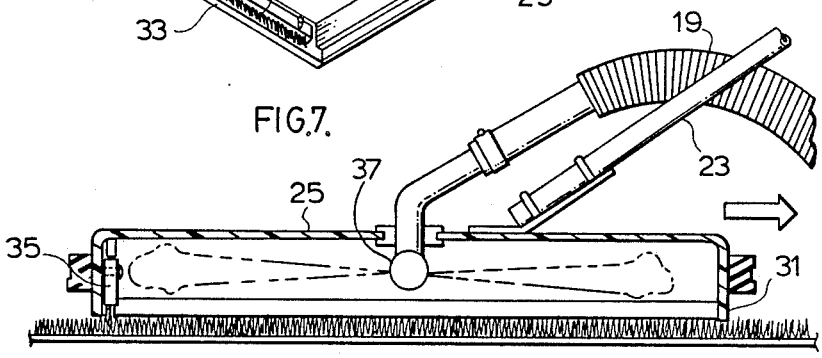
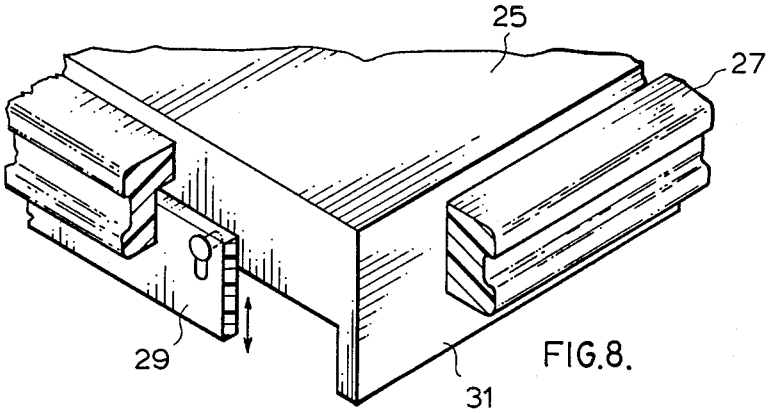
FIG.8.

CARPET REPAIR STEAM SYSTEM

FIELD OF THE INVENTION

The present invention relates to a steam system used for repairing carpet fibres and in particular bent or deformed carpet fibres.

BACKGROUND OF THE INVENTION

Some newly made carpets and rugs are subject to roll marks and/or reverse pile occuring when the carpet is rolled immediately after manufacturing and crushing or deforming the carpet pile. In the case of older carpets having been laid down for three to five months or longer problems such as puddling, pooling, shading and deformed carpet fibres occur particularly in high traffic areas.

In the case of new carpet, the problems only become apparent once the carpet has been shipped and installed and in the case of both new and older carpet, the problems can be so severe that they may require removal and replacement of the carpet. This is an expensive procedure with the damaged carpet generally being sold as seconds or for salvage.

There is very little, if anything, presently available in the way of carpet fibre refurbishers for repairing deformed, bent carpet fibres.

SUMMARY OF THE PRESENT INVENTION

The present invention provides a steam system for repairing bent carpet fibres. This steam system comprises a steam generator and an application tool having a head with a downwardly opening steam chamber operating in an oven-like manner and fed by the steam generator to apply the steam to the bent carpet fibres at a temperature high enough to relax the carpet fibres to the extent to effect the fibre layset with the head further including fibre-lifting means for lifting the fibres to their original upright unbent position after they have been relaxed by the steam.

The steam system of the present invention is not to be confused with steam cleaners or hot water extractors which do apply steam but which do not apply high temperature vapour at the steam levels of the present invention and causing the relaxation required to re-straighten the fibres.

BRIEF DESCRIPTION OF THE DRAWINGS

The above as well as other advantages and features of the present invention will be described in greater detail according to the preferred embodiments of the present invention in which;

FIG. 1 is a perspective view showing an operator using a steam system according to a preferred embodiment of the present invention;

FIGS. 2 and 3 are perspective and side views respectively of damaged carpet to be repaired with the steam system of FIG. 1;

FIG. 4 is a further side view of the carpet after repair.

FIG. 6 is a bottom perspective view of the application tool and in particular the head of the application tool from the steam system of FIG. 1;

FIG. 7 is a sectional view of the head of the application tool of FIG. 6 in operation;

FIG. 8 is an enlarged perspective view showing the outer edge region of the head of the application tool from FIGS. 6 and 7;

DETAILED DESCRIPTION ACCORDING TO THE PREFERRED EMBODIMENTS OF THE PRESENT INVENTION

FIG. 1 shows an operator working on insitu carpet for repairing bent carpet fibres using a steam system generally indicated at 1. FIGS. 2 and 3 show the type of fibre damage that is repaired using the system of the present invention. This damage is in the form of fibres usually deformed during rolling and transporting of the carpet where the fibres are bent as shown in FIGS. 2 and 3. As particularly seen in FIG. 3, the entirety of the fibre may be bent or it may only be bent at the tip of the fibre. However, in both cases this is clearly apparent in the laid carpet. FIG. 4, on the other hand, shows the fibres in an upright position after they have been treated by the steam system of FIG. 1.

Figure 9:
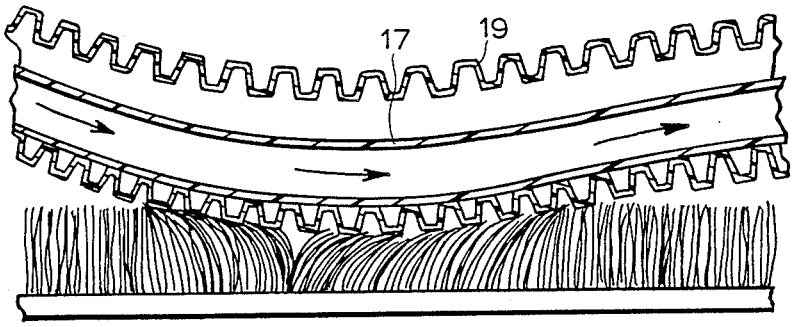
FIG. 9 is a sectional view through the steam transfer hose from the system of FIG. 1.
Figure 10:
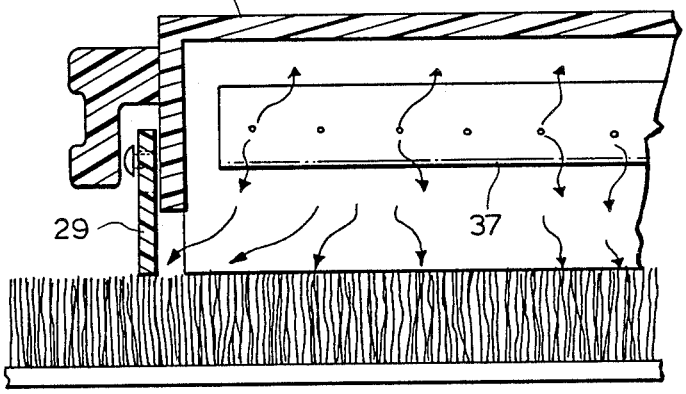
FIG. 10 is a further enlarged cross-sectional view through the head of the application tool from FIGS. 6, 7 and 8.

More particularly, steam system 1 comprises a steam generator 3, an application tool 21 and a steam feed hose from the steam generator to the application tool. This steam hose comprises an inner core 17 and corrugated outer insulating cover 19 as seen in FIG. 9 of the drawings.

Figure 5:
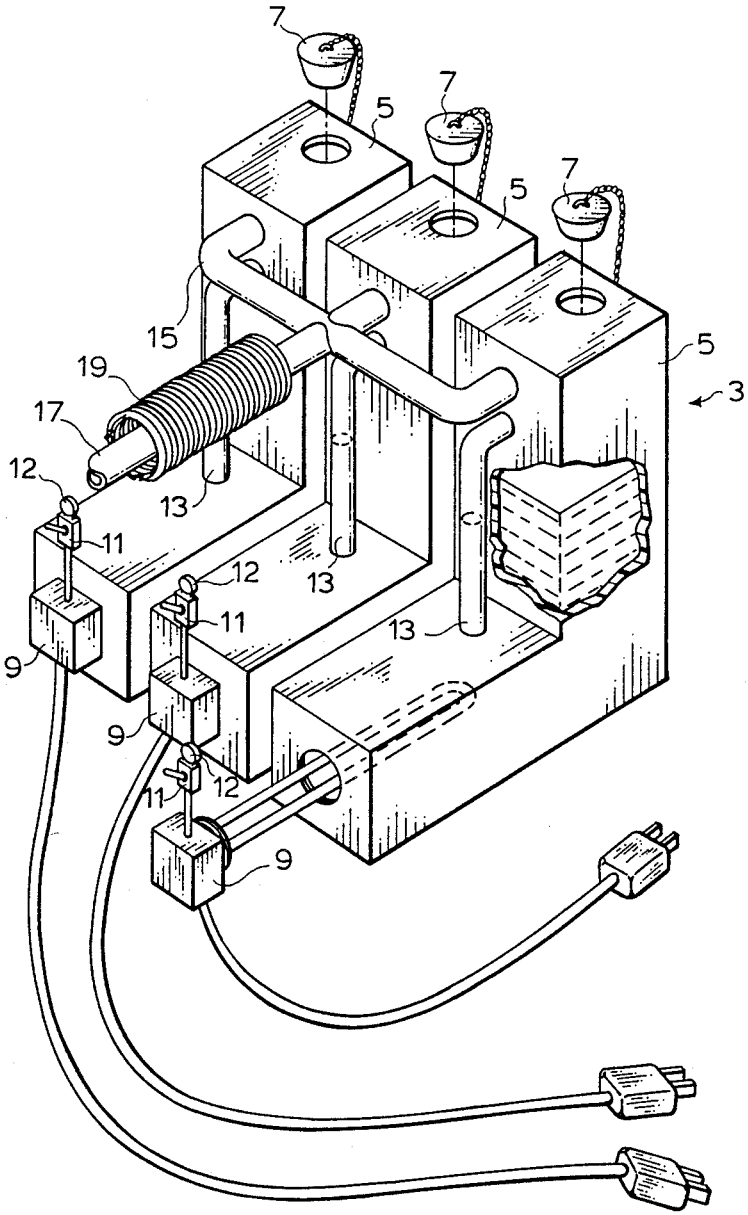
FIG. 5 is a perspective view of the internal workings of the steam generator from the system of FIG. 1.

Reference is now had to FIG. 5 of the drawings which shows the steam generator 3 in more detail. This steam generator comprises a plurality of individual L-shaped housings 5 with top openings for filling the housings with water and stoppers 7 for sealing the openings. According to another embodiment of the invention, the individual stoppers 7 are replaced by a single bar having downwardly facing stoppers for a common mounting of the stoppers and sealed by means of a clamp arrangement atop the individual housings.

Provided at the lower forward leg of each of the housings is a immersion heater 9 with individual on/off switches 11 and indicator lights 12 for each of the immersion heaters. Provided to the front of each housing is a transparent sighting tube 13 indicating the level of water in each of the housings. A steam feed bar 15 again common to each of the housings meets with steam tube 17 insulated outwardly by cover 19.

Application tool 21, best seen in FIGS. 6 through 8 and 10 of the drawings comprises a control handle 23 mounted to head 25 which is fed steam directly through the steam hose from generator 3. The bottom side of head 25 forms a downwardly opening steam chamber defined by a sidewall or shroud running around the full perimeter of the head. The steam is passed into this downwardly opening steam chamber by means of a preferably stainless steel steam tube 37 having a series of small openings along the length of the steam tube as best seen in FIG. 6. Also provided within the steam chamber towards the front of the head of the tool is a stiff bristled brush 35.

In another embodiment of the invention, a larger steam head is provided incorporating two or more steam bars for working on very large areas. Also available is a smaller single steam bar unit specifically designed for fitting on stairs.

Particular reference is now had to FIG. 8 which shows head 25 and the downwardly extending shroud formed around the periphery of the head. The bulk of the head is formed from an aluminum frame with the rear wall 31 being of aluminum construction consistent with the upper part of the frame. However, the aluminum sidewalls are raised by about a quarter of an inch with the sidewalls then being extended downwardly in the form of non-heat conducting side skirts 29 preferably made from a hard rubber or plastic material capable of withstanding steam temperatures. The entirety of the head is then surrounded by a rubber molding 27.

The above shroud construction comprising the aluminum upper frame and aluminum rear wall with elevated side walls completed by downwardly extended non-heat conducting side skirts is to be contrasted with the shroud arrangement found in my own earlier U.S. Pat. No. 4,485,519 issued Dec. 4, 1984 for an OZONE CLEANING SYSTEM. The same OZONE CLEANING SYSTEM is described in my Canadian Pat. No. 1,176,010, issued Oct. 16, 1984 and my own European Pat. No. 0083851, issued Aug. 7, 1985. In each of the above patents, I describe a floating shroud used to trap ozone at the surface of a surface being cleaned. The ozone unit does not use steam for refurbishing purposes and further the shroud comprises a unitary one piece edge not including non-heat conducting portions as required in the present invention to avoid steam lines to the side edges of the head of the cleaning tool.

Figure 11:
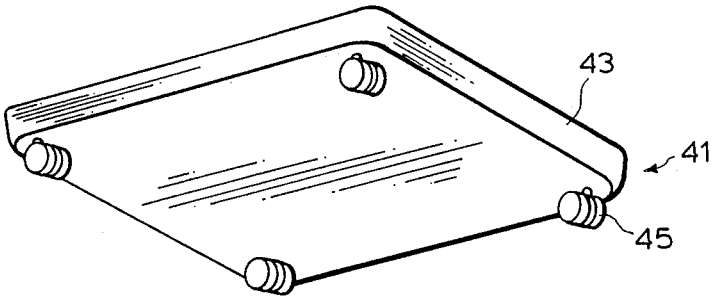
FIG. 11 is a bottom perspective view of a tray used for moving the application tool when it is not in use.
Figure 12:
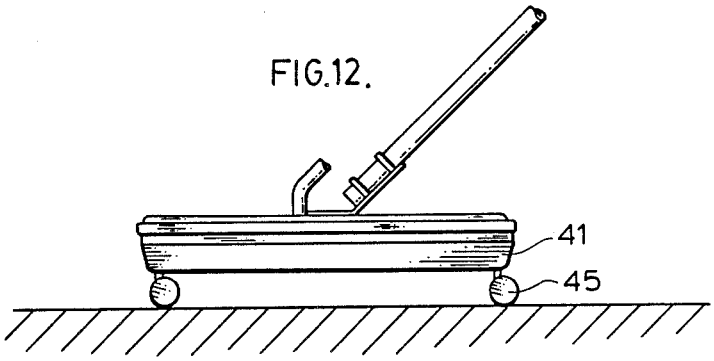
FIG. 12 is a side view of the tool and tray of FIG. 11.
Figure 13:
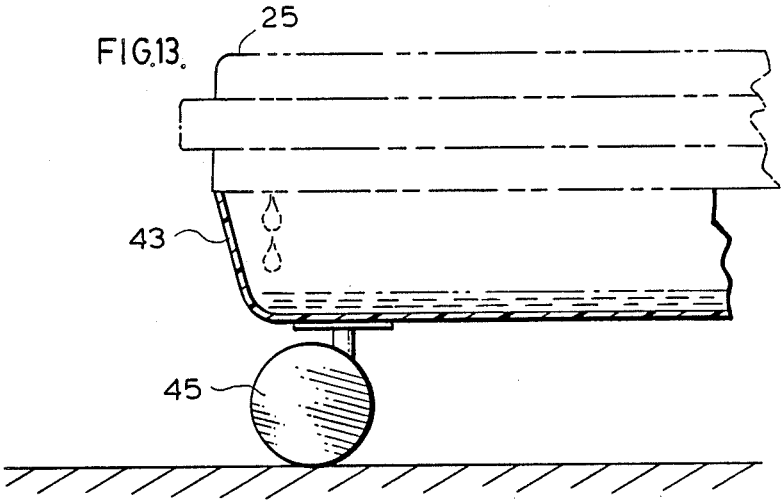
FIG. 13 is an enlarged sectional view of the tool and tray of FIG. 12.

FIGS. 11 through 13 show a tray generally indicated at 1 having an upper water trapping body 43 and lower coasters 45. The head 25 of the application tool sits directly atop this tray which traps any water dripping from the bottom of the head when the tool is not in operation as shown in FIG. 13 of the drawings.

The overall system works as follows, the first step is to fill the steam generator of FIG. 5 with hot water. The water should be kept at a level such that it rises well up into the upright leg portion of each of the housings 5 as shown in partial section in FIG. 5. Sighting tube 13 which show the actual water height are used to determine at a quick glance appropriate filling and required water height during use of the system. It is important that the lower part of the L-shaped housing be totally filled with water to avoid damaging the immersion heaters 9.

One of the unique features of the system of the present invention required for relaxing the carpet fibres for proper reconstruction carpet fibres is that the steam generated at a temperatues of 200° to 212° F. to actually soften fibres and reinstate the original memory by increasing apparent density through swelling of the carpet fibres. This therefore requires a high powered unit which to fit most electrical capabilities, is broken down into a plurality of smaller heaters rather than one large heater. Each of these heaters includes its own electrical cord so that the cords can be plugged into different electrical outlets as shown in FIG. 1 of the drawings. This allows the system to be operated off of different electrical circuits within a home or a building reducing the load on any individual circuit. Each of the switches 11 for the heaters is as earlier noted, provided with its own on/off indicator light 12 making it readily apparent if any of the switches is not actually functioning and/or that the electrical circuits are not blown. For instance, if a fuse blows it will be immediately apparent that one of the immersion heaters is not working so that the situation can be quickly and easily rectified.

The immersion heaters create steam within the individual housings and this steam is forced under its own pressure out of the steam generator through common outlet tube 15 to the feed hose. The feed hose, in turn, delivers the steam under its own pressure to the head 25 of tool 21. Again, it is to be understood that this steam while in the steam hose is at a temperature to actually swell the carpet fibres and it is important therefore that the steam hose be insulated thereby resulting in the double layer construction of the hose. The internal hose portion 17 actually carries the steam while the outer hose cover 19 provides the insulation. This insulation has numerous benefits. Firstly, it allows the operator, as shown in FIG. 1, to hold the hose which would not otherwise be possible because of the high temperature of the hose. Secondly, it substantially eliminates heat loss from the hose which is very important from two standpoints namely, that the heat is maintained with the steam as it is deliveered to the head and secondly, the outside of the hose stays at a temperature that will not affect the fibres where the hose sits on the carpet. From this standpoint, the corrugated construction of the insulated cover has added cooling benefit by providng cooling channels between each of the corrugations making the hose totally safe from damaging the carpet.

The steam, after being delivered to the head of the tool, is as described above dispersed within the steam chamber by means of steam bar 37. The downwardly extending shroud around the steam bar assures that the steam does not escape and is absorbed by the carpet fibres. The steam head acting much like a heating oven is moved slowly over the carpet surface thereby maximizing the effects of the steam. Again, the live steam is delivered at a temperature not to wet the carpet but rather to physically alter its structure so that the fibres can be reset to the original manufacturers upstanding position of FIG. 4. To achieve this, the head is operated by slowly moving it, preferably in the rearward direction indicated in FIGS. 6 and 7 of the drawings where the rear edge 31 of the aluminum housing frame acts as a scraper to provide an initial agressive scraping action on the carpet fibres. The fibres are then subject to the heat within the oven-like steam chamber to cause their softening or relaxing after which they are brushed to an upright position by means of the hard bristled brush 35. This and the front wall of the shroud are the last areas of contact with the fibres so that there is nothing acting on the fibres to return them to a bent position such that they remain upright. Furthermore, the brush is located outwardly away from the stream bar so that by the time the brush reaches the fibres they are ready to reset themselves according to the upright position to which they are brushed.

In some cases it may be more desirable to push the unit forward rather than pulling it backwards as space requires. In this instance the front edge and the brush initially scrape the fibres and it is the rear scraper edge which would cause them to finally move to their upright position after they have been softened by the steam in the oven-like steam head.

As noted above, the side edges of the shroud defining the steam chamber are formed by non-heat cnductive skirts 29. These skirts because they do not reach the extreme temperatures found in the steam chamber thereby avoid heat set in side lines to either side of the head.

In a further preferred embodiment, the steam head 25 may be insulated to cut down on heat loss and condensation within the head. Again this minimizes potential wetting of the carpet unlike a steam cleaning unit to be contrasted to the steam finishing unit of the present invention.

The bumper guard 27 is simply used to prevent the head of the tool from marking any baseboard surfaces or the like along which the tool may be run.

Although various preferred embodiments of the invention have been described in detail, it will be appreciated how variations may be made without departing from the spirit of the invention or the scope of the appended claims.

The embodiments of the invention in which an exclusive property or privilege is claimed are defined as follows:

1. A steam system for repairing bent carpet fibres, said steam system comprising a steam generator and an application tool having a head with a steam chamber fed by said steam generator, said steam chamber being defined by a downwardly opening shroud supporting said tool and trapping the steam at the carpet fibres immediately beneath said shroud to provide an oven-like effect for resetting of the carpet fibres from a bent to an unbent position, said head of said application tool further including fibre lifting means for lifting the fibres to the unbent position after having been relaxed by the steam.

2. A steam system as claimed in claim 1, wherein said steam generator comprises a plurality of individual steam units feeding a common supply tube to said head of said application tool.

3. A steam system as claimed in claim 2, wherein said individual steam units are provided with separate immersion heaters, each of said immersion heaters being provided with its own on/off control and indicator means for indicating on/off operation of said immersion heaters.

4. A steam system as claimed in claim 2, including a water height sighting tube at each of said individual steam units.

5. A steam system as claimed in claim 1, including a steam supply tube form said steam generator to said application tool, said steam supply tube comprising an inner core and an outer insulating cover over said inner core.

6. A steam system as claimed in claim 5, wherein said outer insulating cover comprises a flexible corrugated cover.

7. A steam system as claimed in claim 1, wherein said head of said application tool includes a steam bar extending widthwise thereof, said steam bar being provided with a plurality of steam holes therealong.

8. A steam system as claimed in claim 7, wherein said fibre lifting means comprises a stiff bristled brush separated from said steam tube in said head of said application tool.

9. A steam system as claimed in claim 8, wherein said downwardly directed shroud includes non-heat conductive sides skirts extending between said metallic forward and rearward edge portions.

10. A steam system as claimed in claim 7, said shroud comprising metallic forward and rearward edge portions with at least said rearward edge portion forming a scraper for said head of said application tool.

11. A steam system for repairing bent carpet fibres, said steam system comprising a steam generator and an application tool having a head with a steam chamber fed by said steam generator, said steam chamber being defined by a downwardly opening shroud supporting said tool and trapping the steam at the carpet fibres immediately beneath said shroud to provide an oven-like effect for resetting of the carpet fibres from a bent to an unbent position, said head of said application tool further including fibre lifting means for lifting the fibres to the unbent position after having been relaxed by the steam, said application tool being connected to said steam generator by a steam supply hose, said supply hose being insulated to maintain high temperature of the steam passing through said hose with an external hose temperature below that to cause resetting of any carpet fibres on which said hose is laid.

12. A steam system as claimed in claim 11, wherein said hose comprises an inner core and an outer corrugated insulating cover over said inner core.

* * * * *